US008020758B2

(12) United States Patent
Gunst et al.

(10) Patent No.: US 8,020,758 B2
(45) Date of Patent: Sep. 20, 2011

(54) APPARATUS AND METHOD FOR ADDING NOTE DISPENSING POSITIONS TO A SECURE CASH DISPENSER

(75) Inventors: Robert E. Gunst, Neosho, WI (US); Michael Bielamowicz, Naperville, IL (US)

(73) Assignee: Talaris Inc., Watertown, WI (US)

( * ) Notice: Subject to any disclaimer, the term of this patent is extended or adjusted under 35 U.S.C. 154(b) by 505 days.

(21) Appl. No.: 12/294,699

(22) PCT Filed: Mar. 27, 2007

(86) PCT No.: PCT/US2007/007667

§ 371 (c)(1), (2), (4) Date: Oct. 23, 2008

(87) PCT Pub. No.: WO2007/126878

PCT Pub. Date: Nov. 8, 2007

(65) Prior Publication Data

US 2010/0170911 A1 Jul. 8, 2010

Related U.S. Application Data

(60) Provisional application No. 60/786,915, filed on Mar. 29, 2006.

(51) Int. Cl.
*G07D 11/00* (2006.01)

(52) U.S. Cl. ..... 235/379; 235/474

(58) Field of Classification Search ..... 235/379, 235/474, 475, 486, 487; 221/1, 217, 21, 221/251

See application file for complete search history.

(56) References Cited

U.S. PATENT DOCUMENTS

| | | | | |
|---|---|---|---|---|
| 4,494,747 | A * | 1/1985 | Graef et al. | 271/263 |
| 4,615,280 | A * | 10/1986 | Shoop et al. | 109/24.1 |
| 4,660,822 | A * | 4/1987 | Winkler et al. | 271/10.11 |
| 4,877,230 | A * | 10/1989 | Winkler et al. | 271/3.15 |
| 6,443,359 | B1 | 9/2002 | Green et al. | |
| 7,857,206 | B2 * | 12/2010 | Gunst et al. | 235/379 |
| 2004/0113581 | A1 * | 6/2004 | Kobayashi et al. | 318/685 |
| 2006/0289628 | A1 * | 12/2006 | Gunst et al. | 235/379 |
| 2007/0158407 | A1 * | 7/2007 | Gunst et al. | 235/379 |
| 2010/0170911 | A1 * | 7/2010 | Gunst et al. | 221/1 |

* cited by examiner

*Primary Examiner* — Thien M Le
(74) *Attorney, Agent, or Firm* — Boyle Fredrickson, S.C.

(57) ABSTRACT

A note presenter and method is disclosed for dispensing notes at a plurality of dispensing locations that are spaced apart such that two or more persons can be positioned at the dispensing locations at one time. The note presenter is attached to a secure container for receiving the cash at a single exit slot and includes a rotatable mechanism for repositioning the cash in alignment with either one of the two dispensing locations, and a linearly moveable part to withdraw the notes from the exit slot and to extend the notes to either one of the two dispensing locations to two or more persons who can be positioned at the dispensing locations. Several different configurations are disclosed.

20 Claims, 9 Drawing Sheets

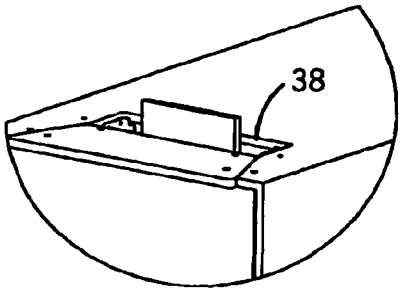
FIG. 10
(PRIOR ART)
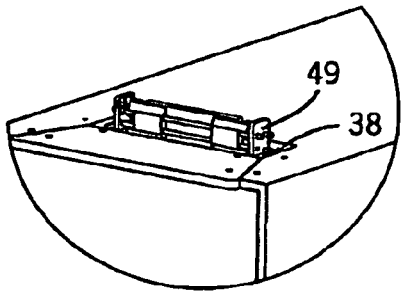
FIG. 11
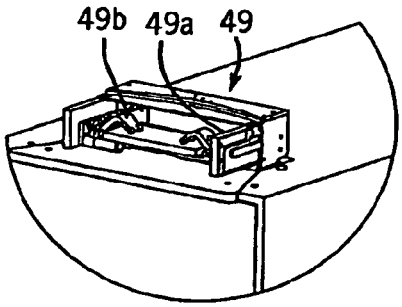
FIG. 12
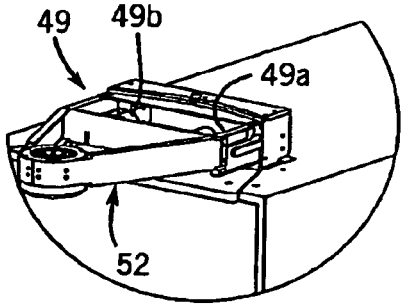
FIG. 13
FIG. 14
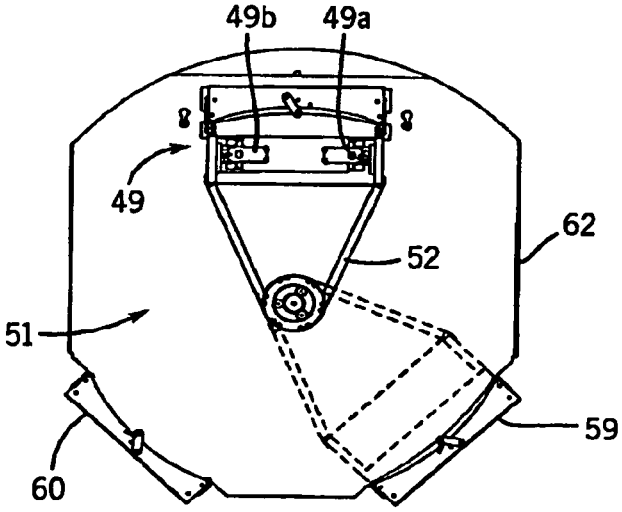

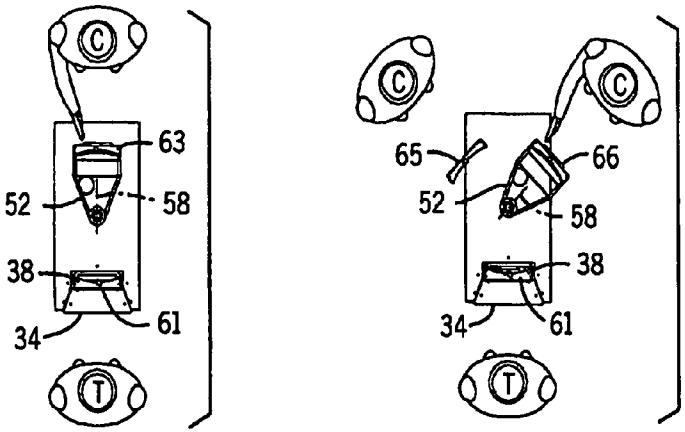
FIG. 15
FIG. 16
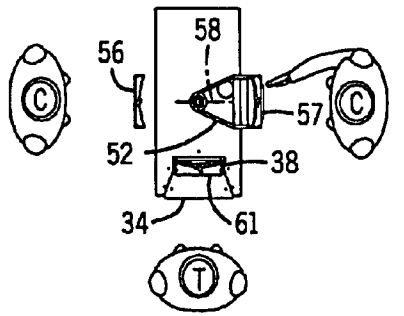
FIG. 17
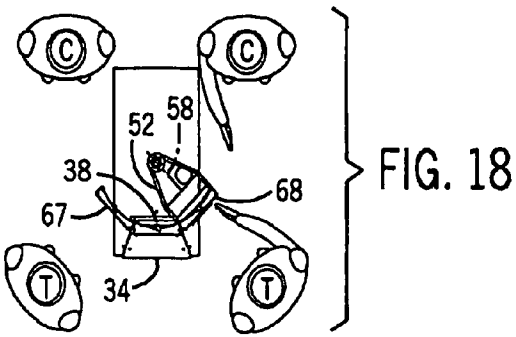
FIG. 18
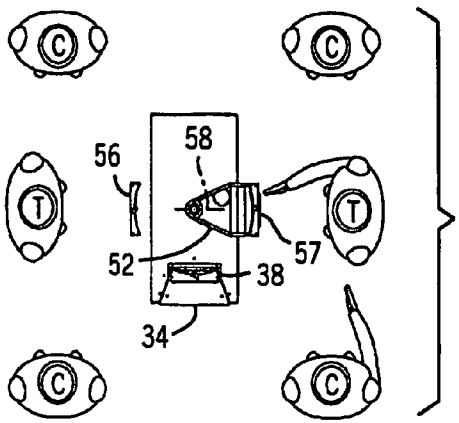
FIG. 19

APPARATUS AND METHOD FOR ADDING NOTE DISPENSING POSITIONS TO A SECURE CASH DISPENSER

CROSS-REFERENCE TO RELATED APPLICATIONS

The benefit of priority based on U.S. Provisional Pat. App. No. 60/786,915 filed Mar. 29, 2006, is claimed herein.

TECHNICAL FIELD

The field of the invention is secure cash dispensers and teller vaults of the type used in financial and retail businesses.

BACKGROUND OF THE INVENTION

An example of such a device is commercially offered by the assignee herein under the trade designation of the Benchmark Series® 7 Teller Cash Dispensing System. A description of its internal apparatus is provided in Gunst, U.S. Pat. No. 6,595,606, issued Jul. 22, 2003. Notes are dispensed out of a cash dispensing slot opening upwardly on a top of the machine.

Granzow et al., U.S. Pat. No. 4,564,122, issued Jan. 14, 1986, and Placke et al. U.S. Pat. No. 4,577,763, issued Mar. 25, 1986 disclose a teller cash station with the ability to dispense notes to a teller on the right or a teller on the left. There is no forward movement out of the teller cash drawers prior to the movement to the right or the left.

Graef, U.S. Pat. Pub. No. US2004/0178568 discloses a cash dispensing cassette for an ATM machine. The cassette does not provide for movement of the notes to the right and left.

SUMMARY OF THE INVENTION

The invention concerns an improvement in a cash dispenser unit for use in customer service areas. In particular, a note presenter is provided so that notes will that are moved out of a secure container and are then moved to dispensing positions to a right side or a left side so as to service customers on opposite sides of a portion of the machine.

With the invention, cash is moved out of the cash drawers before moving it to the right or left. The note presenter will receive a bundle of notes from a traditional cash dispensing slot and may be pivoted up to 360° around a pivot point to present notes at a plurality of dispensing locations. Besides pivoting, the note bundle can be advanced axially from the pivot point to present the notes at a dispensing location. Generally, there is an enclosure around a portion of the cash dispensing unit, so that only the cash delivery locations are accessible to the customers.

The cash dispenser unit can be accessed on one aide by financial or retail customers. The unit is capable of both unassisted and assisted configurations have different numbers of cash dispensing positions. A teller may have access to the dispensing area from the secure vault portion of the dispenser to clear jams and receive cash not accepted by customers.

Other objects and advantages of the invention, besides those discussed above, will be apparent to those of ordinary skill in the art from the description of the preferred embodiments which follows. In the description, reference is made to the accompanying drawings, which form a part hereof, and which illustrate examples of the invention.

BRIEF DESCRIPTION OF THE DRAWINGS

FIG. 10 is a perspective view of a cash dispensing slot of the prior art;

FIGS. 11-14 are perspective detail views of a preferred embodiment of a note presenter of the present invention;

FIGS. 15-24 are plan diagrammatic views of various arrangements of the note presenter of FIGS. 11-14 in different configurations of a secure cash dispenser according to the present invention;

DETAILED DESCRIPTION OF THE PREFERRED EMBODIMENTS

Figure 1:
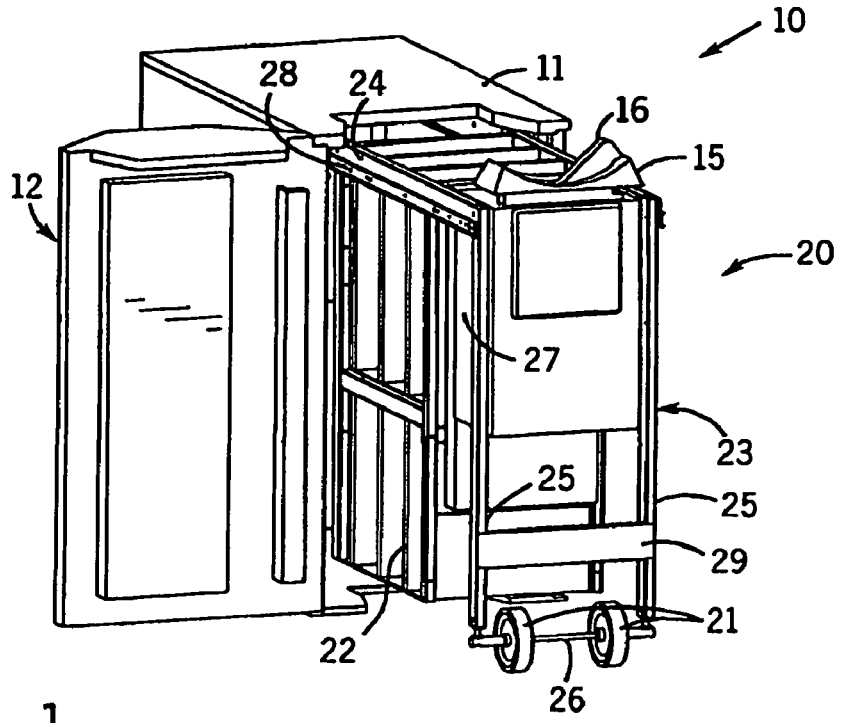
FIG. 1 (PRIOR ART)
FIG. 1 is a perspective view of a secure cash dispenser of the prior art.

FIG. 1 shows a device 10 known in the art as a secure cash dispenser which is modified according to the present invention for use in customer self-service areas in a bank, credit union or other financial institution, supermarkets, retail establishments and in the gaming industry or anywhere that substantial amounts of cash are handled. One well known type of secure cash dispenser is used in banks, including drive-in windows, for dispensing currency, predominantly notes, to customers making withdrawals. These secure cash dispensers are sometimes referred to as teller vaults or as teller cash dispensers, depending on the level of security. They provide a sturdy, locked enclosure, like a safe, which is resistant to forcible entries and secure against unauthorized access to the substantial amounts of cash stored therein.

An example of such a device is commercially offered by the assignee herein under the trade designation of the Benchmark Series® 7 Teller Cash Dispensing System. A description of its internal apparatus is provided in Gunst, U.S. Pat. No. 6,595,606, issued Jul. 22, 2003.

As seen in FIG. 1, which is an example of the prior art, a rolling drawer assembly 20 has a plurality of cash drawer compartments 22 for holding denominations of currency in cash drawers such as $1, $5, $10, $20, $50 and $100 in the U.S. When the drawers are empty, they can be filled with currency and inserted in the drawer assembly 20, providing that the door 12 to the apparatus 10 is open and the drawer assembly 20 has been pulled out to its extended position. The drawer assembly 20 can then be rolled into the enclosure 11 and the door 12 can be closed and locked. The cash dispenser 10 can also be adapted to handle Canadian currency, UK currency and euros. Obviously, the invention is also suitable for many other currencies throughout the world.

When the door 12 is unlocked and opened as seen in FIG. 1, the carriage drawer assembly 20 can be seen. This assembly 20 includes a pair of front wheels 21 on which the assembly 20 is rolled along the floor. A bezel 15, which is a frame for a dispensing slot, and a currency dispensing mechanism 16 in the slot are positioned at the end of the dispenser near the door 12 and are received in a recess in the top wall of the enclosure 11. The wheels 21 will assist the pulling forward of the drawer assembly 20 to an extended position and returning the drawer assembly inside the enclosure 11 for dispensing operations.

The drawer assembly 20 is mounted on a frame 23 including top members 24 disposed horizontally and two spaced apart front members 25 disposed vertically. The wheels 21 are mounted by an axle 26 to the lower ends of the front members 25. The front members 25 are braced by cross members 29.

Towards the front of the assembly 20, in front of the drawers 22, is an electrical control section 27 which includes a motor and electronics for controlling operation of the apparatus 10 including the currency dispensing mechanism 16. The control section 27 may include dials (not shown) for setting the denominations of the currency drawers 22.

At the top of the drawer assembly 20, two slide members 28 are mounted to opposite sides near the spaced apart top members 22. These slide members 28 are parts of two drawer-type slide assemblies each having a pair of complementary sliding members. Bearings are included in the slide assemblies and disposed between the sliding members 28. The other sliding members in the assemblies are positioned on the inside of the enclosure body to receive the slide members 28. Other constructions of secure cash dispenser known in the art or shown in the literature can also be used provided they dispense cash from a slot in an upper wall of the enclosure.

The present invention provides several embodiments 31, 50 and 51 of a modular note presenter unit that can be mounted on an existing TCD Series 7™ cash dispenser 30 without compromising the security of the cash dispenser 30. The presenter units 31, 50 and 51 interface to the cash dispenser electronics by sensing the existing exit sensor signal and holding the signal blocked until the banknotes have been presented to the customer. The notes exit the single slot 38 in the cash dispenser 30 and are moved to one of the new, multiple delivery slots, which may include access doors. The presenter units 31, 50 and 51 each include their own power source, electronic controls, and software systems independent of the cash dispenser 30. The presenter units 31, 50 and 51 are designed to assemble to the cash dispenser 30 at the point of installation, or as a field retrofit. They are low profile so as fit under a customer counter 40, if necessary, and are in the range of height of no more than three to four inches in that application.

Figure 2:
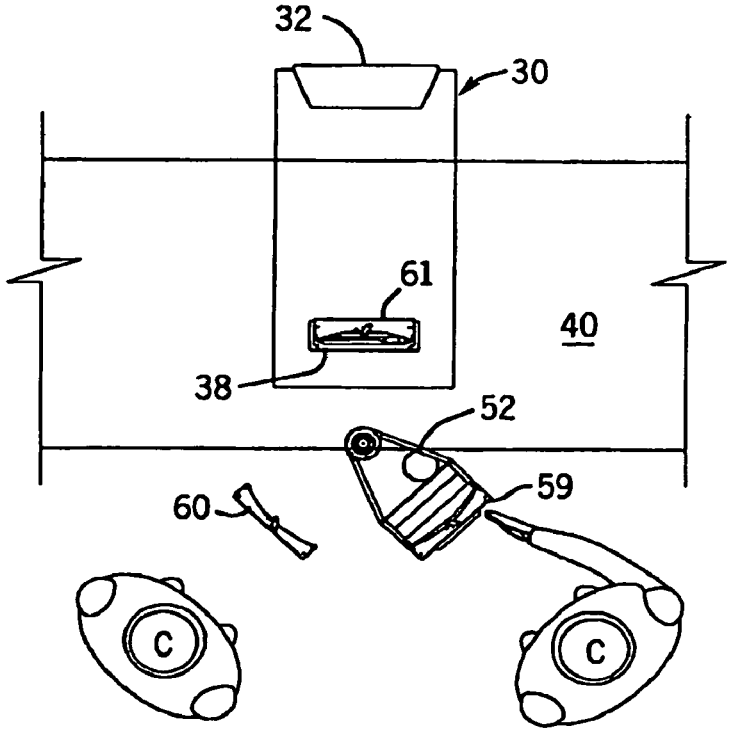
FIG. 2 is a top plan view of a cash dispenser utilizing a note presenter of the present invention.

FIG. 2 illustrates a schematic of a cash dispenser 30 with a note presenter unit 51 of the present invention as installed in a customer counter 40 for use by two customers, C. The door 32 of the cash dispenser 30 is accessible only to employees behind the counter 40. A dispense slot 38 and dispensing bezel 61 are disposed towards an opposite end and oriented to face the customers, C. A rotary transport mechanism 52 is provided for accepting bundles of notes and transporting them to customer dispensing locations defined by bezels 59 and 60.

Figure 3:
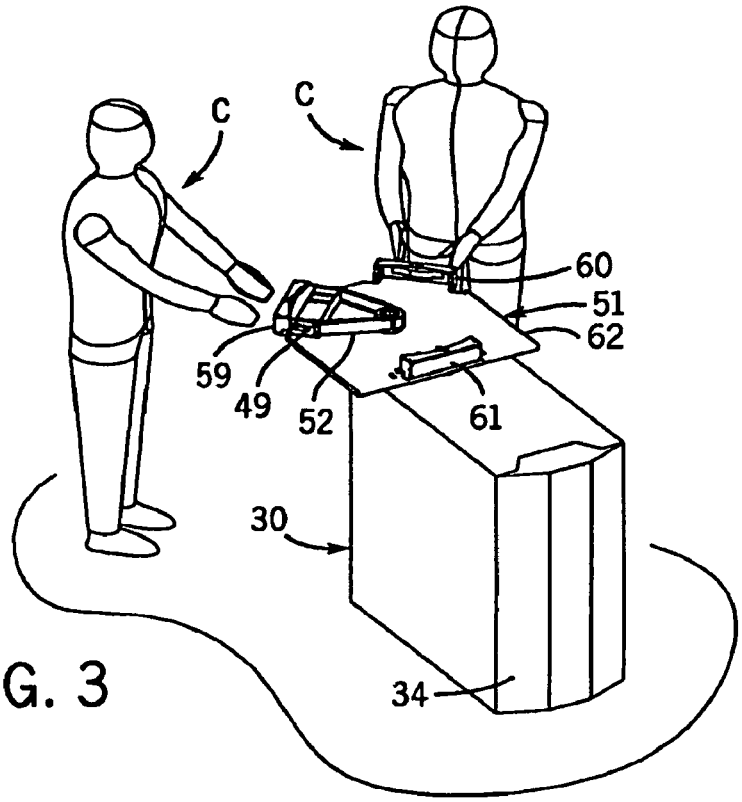
FIG. 3 is a perspective view of the cash dispenser of FIG. 2.
Figure 4:
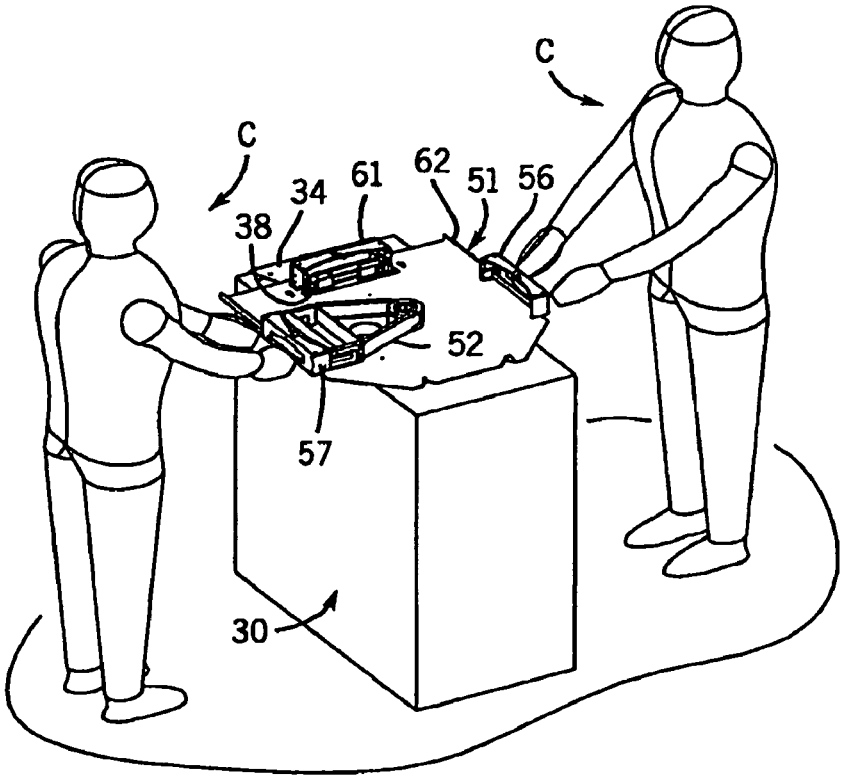
FIG. 4 is a perspective view of a second embodiment of the cash dispenser of FIG. 2.
Figure 5:
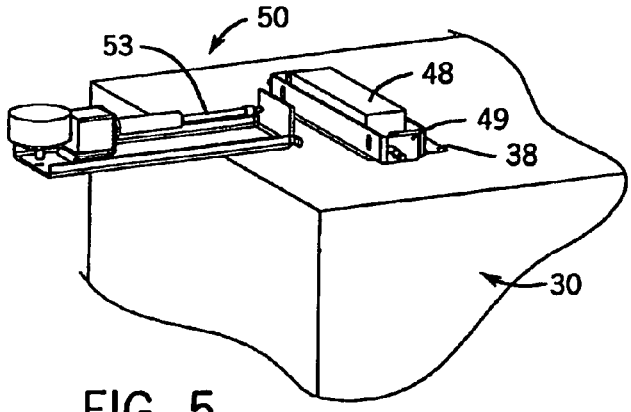
FIGS. 5, 6 and 7 are perspective detail views of an alternative embodiment of a note presenter of the present invention.

FIG. 3 shows the modular presenter unit 51 being used by two customers, C. There is also a support 62 for the rotary transport mechanism 52 for extension beyond the end of the secure cash dispenser enclosure 30. FIG. 4 shows a self-service configuration in which the modular presenter unit 51 is reversed in position relative to the cash dispenser exit slot 38 for use by two customers, C. In FIG. 4, the bezel 61 faces the more distant end of the secure cash dispenser 30 and the support 62 is reversed, with note bundles emerging from the slot 38 toward the longer end of the secure cash dispenser 30. The slot 38 is close to the end with door 34 to the secure enclosure 30. This self-service configuration is suitable for addition of dispensing locations, such as the triple dispensing configuration shown in FIG. 21.

In FIGS. 20-24, the bezels 56, 57, 59 and 60 are designed to integrate with common commercial furniture units that might be used in a dispensing location for customers. The bezels 56, 57, 59 and 60 can be provided by indicator lights to show that the openings are clear or that cash is present for removal. Sound alerts can also be used to signal that cash is present or to confirm that it has been removed. After a timed interval, such as twenty (20) seconds, the notes can be retracted from the bezel slot and returned to an interior portion of the modular cash dispensing unit 51. Movable security doors with tamper detection can be used in the exit slots defined by the bezels 56, 57, 59 and 60. The secure cash dispenser 30 and note presenter 51 can be housed in a kiosk surround that completely encloses the equipment except for the dispensing slots of the note presenter 51.

Other user interface equipment, such as touch screens 39, keyboards, mice and other input and output devices can be installed in the kiosk or in the customer counter 40 seen in FIG. 2, on opposite sides of the cash dispenser 30, so as to service two customers at once.

FIGS. 10-14 are detail views of the prior art slot 38 (FIG. 10) before and after addition of a carriage 49 and a preferred embodiment of a rotary transport mechanism 52 (FIGS. 11-14) for handling the bundle of notes. FIG. 11 shows the carriage 49 emerging from the slot 38. FIG. 12 shows the rotation of the carriage 49 ninety degrees to present the notes horizontally. FIG. 12 also shows that carriage 49 includes a slide mechanism 49*a* for moving the bundle of notes in a horizontal direction, and fingers 49*b* for holding the notes with tension, until the notes are pulled out of the mechanism by a customer. FIG. 13 shows a rotary transport mechanism 52 being added to the carriage mechanism 49. This mechanism 52 has two arms which from a triangle with the carriage 49. FIG. 14 shows a schematic of the modular unit 51, including a support 62, which may be part of an enclosure for the unit 51 to be added to a secure cash dispenser 30. The modular presenter unit 51 includes a rotary transport mechanism 52 to move the note bundle 48 to a dispensing opening defined by a bezel 59 at a first location that is one hundred and twenty degrees clockwise from the slot 38, or to a dispensing opening defined by a bezel 60 at a second location that is two hundred and forty degrees clockwise from the slot 38. The rotary mechanism 52 can move in either a clockwise or counter-clockwise direction to reach the dispensing locations. Upon reaching the proper angular position, a slide mechanism 49*a* is activated to present a bundle of notes through a respective bezel 59, 60 to a customer. The customer will have a timed period to remove the notes by pulling them from the frictional gripping mechanism 49*b*.

FIGS. 15-19 show five possible configurations for a full service teller operated currency cash vault 30 using a currency presenter 51 of the present invention as described in relation to FIGS. 2-4 and 10-14. In these configurations, "T" means a teller or operator and "C" means a customer. The dispensing mechanism would be controlled by the teller "T" as opposed to any automatic type of operation used for self-service operations. FIG. 15 shows a mode of operation where an axis 58 of the rotary transport mechanism 52 is rotated one hundred and eighty degrees)(180° from the cash dispensing slot 38. FIG. 16 provides cash dispensing bezels 65, 66 defining cash dispensing openings at one hundred and twenty degrees)(120° and two hundred and forty degrees)(240° of rotation of the axis 58 from the slot 38 of the secure cash dispenser enclosure. FIG. 17 shows a mode of operation, where the bezels 56, 57 defining the cash dispensing openings for the two respective customers, C, are disposed at ninety degrees (90°), and two hundred seventy degrees (270°) of clockwise rotation of the axis 58 relative to exit slot 38 of the secure cash dispenser enclosure. FIG. 18 shows a configuration in which the dispensing locations are relative to tellers, T, and are located at plus forty-five degrees (+45° and minus forty-five degrees (−45°) from the longitudinal axis 58 of the carriage mechanism 52. FIG. 19 shows a configuration in which the dispensing locations are relative to tellers, T, and are located at ninety degrees (90° and two hundred and seventy degrees (270°) from a zero-degree position defined by the axis 58 of the carriage mechanism 52. In this configuration the tellers, T, receive the cash and dispense it manually to customers C through a window or over a counter. In these configurations, the rotary mechanism 52 can move in either a clockwise or counterclockwise direction to reach the dispensing locations.

Figure 22:
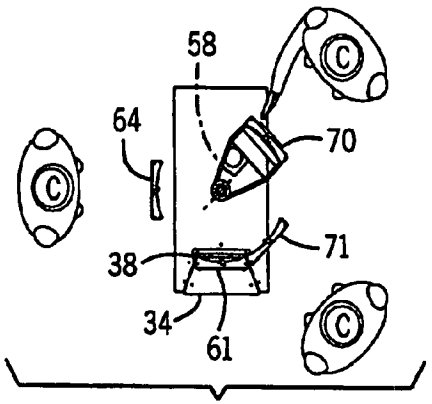
Figure 21:
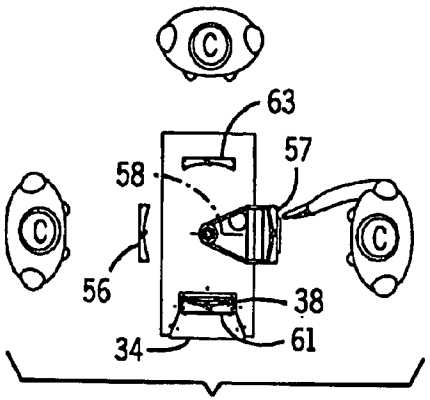
Figure 20:
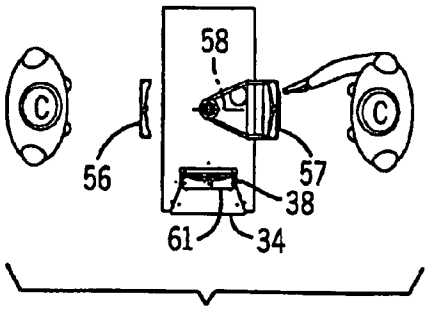
Figure 24:
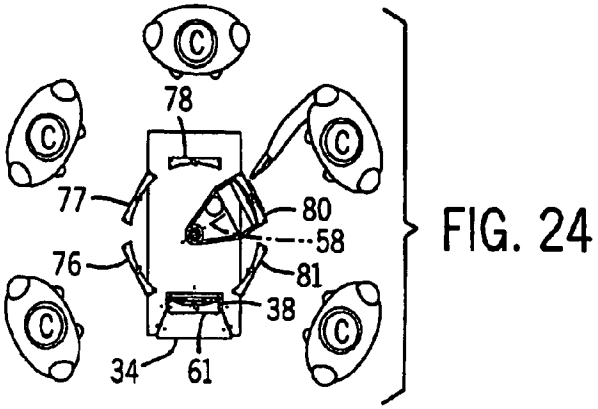
Figure 23:
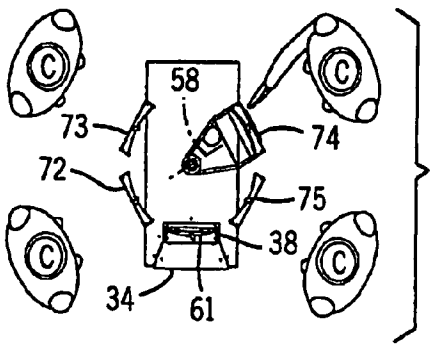

FIGS. 20-24 show various configurations for dispensing to customers, C, in a self-service operation. FIG. 20 shows two dispensing positions at ninety degrees (90°) and two hundred and seventy degrees (270°), respectively, of rotation from a zero-degree position defined by the longitudinal axis 58 of the carriage mechanism 52. FIG. 21 shows a bezel 63 at a third dispensing position at one hundred and eighty degrees (180°) of rotation from a starting position for the bundle 48. FIG. 22 shows three bezels 64, 70 and 71 at three dispensing positions at ninety degrees (90°), two hundred twenty-five degrees (225°) and three hundred fifteen degrees (315°) of rotation from a zero-degree position defined by the axis 58 of the carriage mechanism 52. FIG. 23 shows bezels 72-75 at four dispensing openings sixty degrees (60°), one hundred twenty degrees (120°), two hundred and forty degrees (240°) and three hundred degrees (300°) of clockwise rotation from a zero-degree position defined by rotation of an axis 58 of the carriage mechanism 52 to place the note bundle 48 are the respective. FIG. 24 shows five dispensing openings 76-81 spaced at intervals of sixty angular degrees following a clockwise rotation from a zero-degree position defined by an axis 58 of the carriage mechanism 52. In these configurations, the rotary mechanism 52 can move in either a clockwise or counterclockwise direction to reach the dispensing locations.

Figure 6:
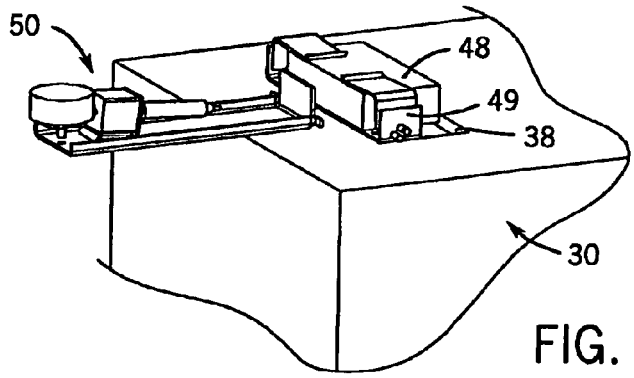

A second embodiment of the present invention is shown in FIG. 5-9, as a rotary type of cash presenter 50. A bundle of notes 48 is seen as it exits from the secure cash dispenser 30 through its single slot 38. The cash presenter first performs a gripping action by which a carriage mechanism 49 releasably grips the bundle of notes on two sides. The cash presenter 50 has an actuator arm 53 for extension and retraction of the carriage mechanism 49. This arm 53 and the bundle of notes 48 can be moved around a 360-degree circle. Referring next to FIG. 6, a bundle of notes can also be rotated ninety degrees around its own longitudinal axis so that the notes are presented horizontally to an operator or to a customer. This would be accomplished by a motor coupled to the carriage mechanism 49 to rotate a portion of the carriage mechanism 49 positioned outside the slot 38.

Figure 7:
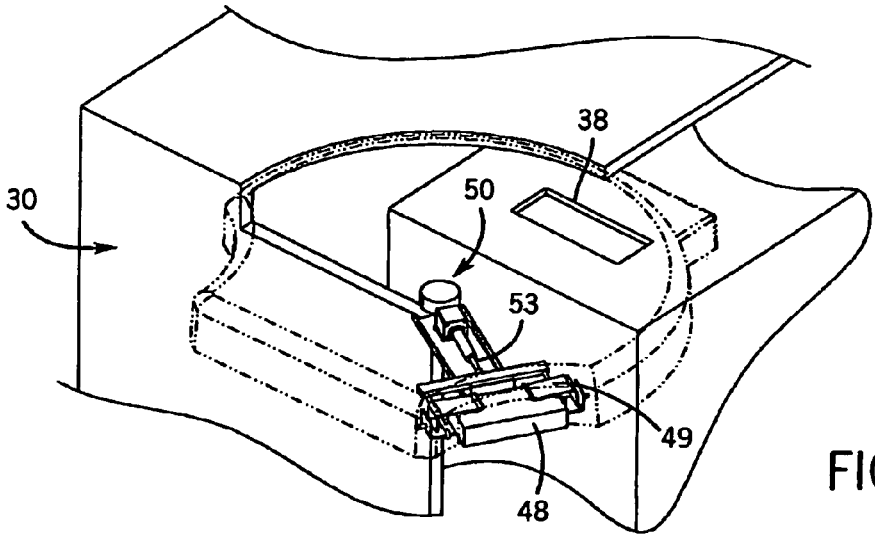
Figure 8:
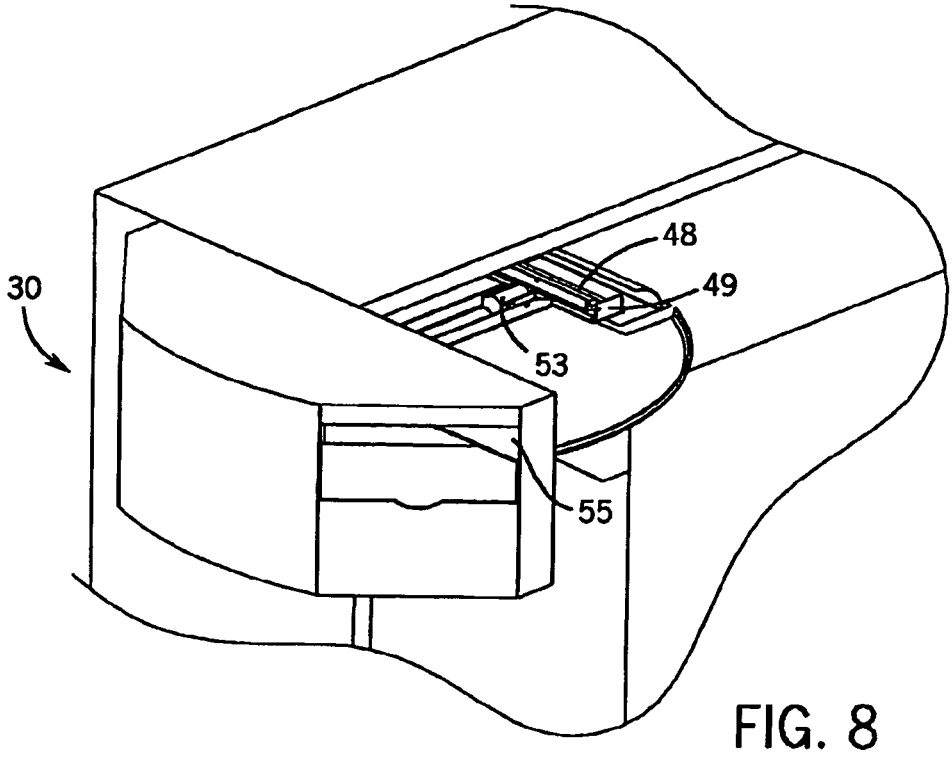
FIGS. 8 and 9 are perspective views of alternative embodiments of the note presenter of FIGS. 5, 6 and 7.
Figure 9:
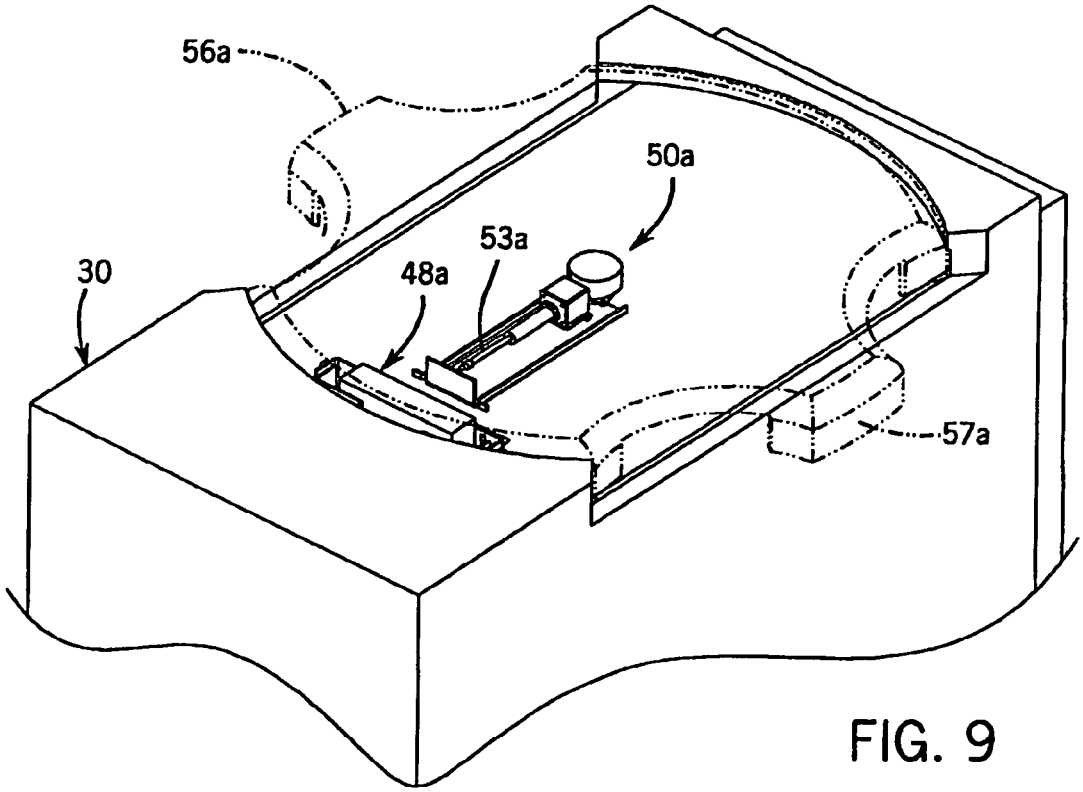

FIG. 7 shows that the note bundle 48 is moved by a 120-degree rotation of the arm 53 and held in a horizontal position within the secure enclosure 30 before being presented to an operator or to a customer. Next, as shown in FIG. 8, the arm 53 is extended to move the note bundle 48 through an opening in a cover 55 attached to the secure cash dispenser 30. A door (not shown) can be used to close the opening when notes are not being presented. Other openings can be located at positions around a 360-degree circle. FIG. 9 is an example where the note bundle 48 is moved ninety degrees (90°) or two hundred seventy degrees (270°) to two dispensing locations **56*a*, 57*a* on either side of a secure cash dispenser 30. In the above examples, if the cash is not removed within a certain time period, the arm will be moved back into the secure enclosure 30** to an error position or to a secure dump container for receiving cash not removed from the machine in a timely fashion.

Figure 25:
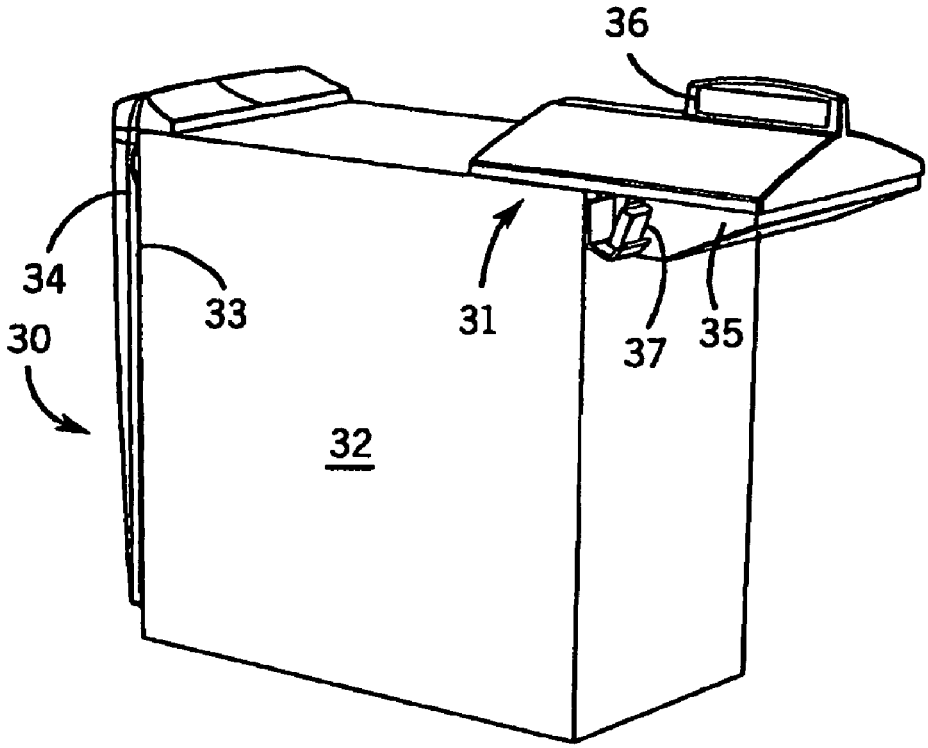
FIG. 25 is a perspective view of a cash dispenser showing a housing for the note presenter.

In another embodiment of the present invention, as illustrated in FIG. 25, a new note presenter 31 is provided towards an end of an enclosure 32 for a secure cash dispenser 30 that is opposite the end 33 with the door 34. The internal apparatus of the cash dispenser 30 includes a drawer assembly as described above for the prior art. The currency dispenser 31 includes a currency dispenser housing 35 that extends from the opposite end. On top of the housing are visual displays 36 or advertising facing in opposite directions perpendicular to a longitudinal direction of the enclosure 32. The housing 35 has openings 37 on opposite sides facing in the same direction as the displays 36, so that a bundle of notes can be dispensed to either a right side or a left side so as to service customers on opposite sides of the cash dispenser 30.

Figure 26:
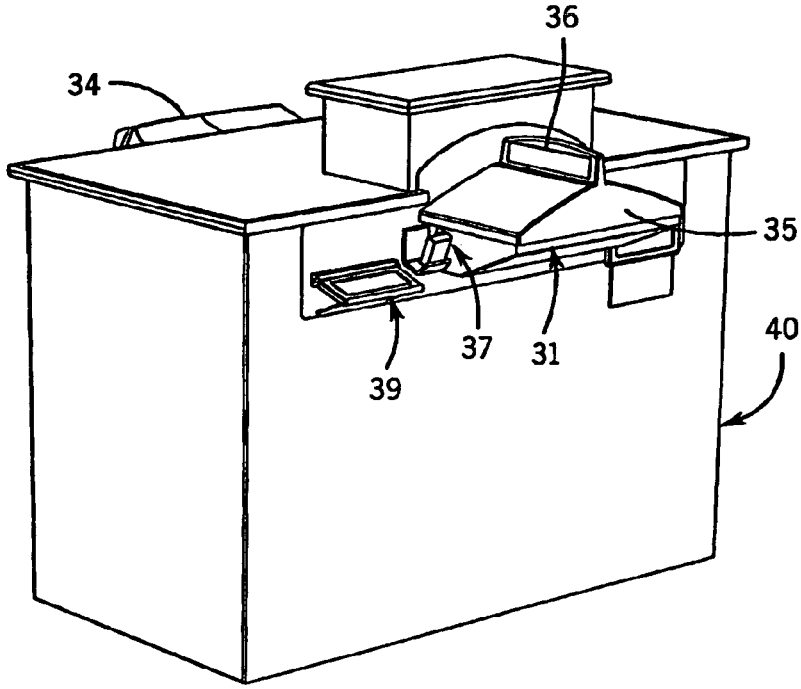
FIG. 26 is a perspective view of an installation of the cash dispenser of FIG. 25 in a counter or island.

As seen in FIG. 26, the secure cash dispenser 30 is mounted in a counter 40 with only the currency dispensing housing 35 extending outside the counter 40. The cash dispenser enclosure 32 is hidden for the most part within the counter 40, with the door 34 being accessible from a back side of the counter 40. There may be a wall or partition (not shown) between the front side and back side of the counter to limit access of customers to the front side of the counter 40.

Figure 27:
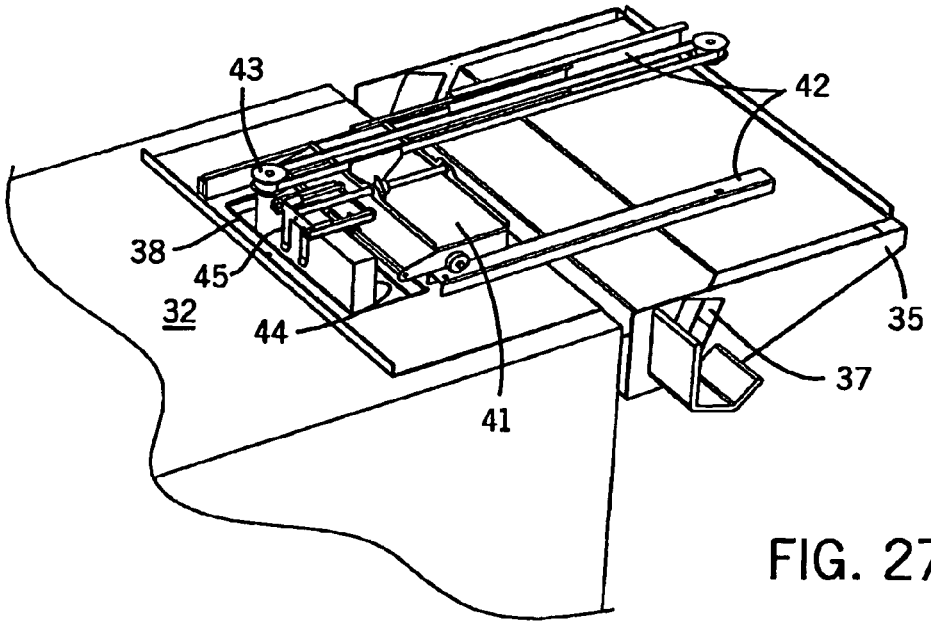
FIG. 27 is a view of the cash dispenser of FIGS. 25 and 26 with parts removed to show the details of the note presenter.

As seen in FIG. 27, with the housing 35 for the currency dispenser 31 removed, a bundle of notes 44 is moved upwardly through the exit slot 38 in the cash dispenser 30, and held by a finger-gripping mechanism 45, which is positioned to move forwardly along a pair of substantially horizontal tracks 42 with the aid of a powered belt 43. A side-to-side sliding mechanism 41 slides laterally relative to the first direction of forward movement to move the bundle of notes either to the right or left to exits 37 in the note presenter housing 35.

There is a forward movement out of the cash dispensing slot prior to the movement to the right or the left or as a result of a rotational movement. This movement is beneficial in clearing the counter 40 in which the cash dispenser 30 is installed and providing service to at least two customers at different locations.

This description has been of a multiple slot, cash dispensing unit 31, 50, 51 that can be provided as an add-on to a single slot secure cash dispenser enclosure. This expands a single dispensing slot to multiple dispensing slots for dispensing currency at varying positions that are convenient to customers around three hundred and sixty degrees of pivoting of a currency transport mechanism. This helps serve more customers in a self-service mode or assisted mode of handling customer financial transactions.

This has been a description of the preferred embodiments, but it will be apparent to those of ordinary skill in the art that variations may be made in the details of these specific embodiments without departing from the scope and spirit of the present invention, and that such variations are intended to be encompassed by the following claims.

The invention claimed is:

1. A note presenter apparatus for assembly on a secure container having only a single exit slot for dispensing notes, the note presenter apparatus repositioning the notes in alignment with either one of at least two dispensing locations, the note presenter apparatus comprising two dispensing locations, a linearly moveable part to retract the notes from the single exit slot, a rotatable part for moving the notes in a circular motion to a vicinity of either one of the two dispensing locations, and a gripper for gripping a plurality of notes presented at the single exit slot of the secure container and for gripping the notes as the notes are transported to either one of two dispensing locations, wherein the notes are presented for release of the notes from the gripper by a customer.

2. The note presenter apparatus of claim 1, wherein the rotatable part is pivotable around a 360° circle of rotation including a starting position at the single exit slot and is positionable at any location around the 360° circle.

3. The note presenter apparatus of claim 2, wherein the two dispensing locations are located at 120° and 240° relative to an axis extending between a pivot point for the rotatable part through a center of the circle of rotation.

4. The note presenter apparatus of claim 3, wherein the dispensing locations include openings to a right and left side of a housing for the note presenter apparatus that extends forward from the secure container.

5. The note presenter apparatus of claim 2, wherein the two dispensing locations are located at 90° and 270° relative to an axis extending from a pivot point for the note presenter apparatus through a center of the circle of rotation.

6. The note presenter apparatus of claim 5, further comprising a third dispensing location located at 180° relative to an axis extending between a pivot point for the note presenter apparatus through a center of the circle of rotation.

7. The note presenter apparatus of claim 5, wherein the dispensing locations include openings to a right and left side of a housing for the note presenter apparatus that extends forward from the secure container.

8. The note presenter apparatus of claim 7, wherein sliding doors are positioned to open and close the openings in the right and left side of the housing for the note presenter apparatus.

9. The note presenter apparatus of claim 7, further comprising a visual electronic display integrated into the housing for the note presenter apparatus.

10. The note presenter apparatus of claim 1, wherein the secure container is disposed in a counter with the note presenter facing outwardly from one side of the counter and with an access door to the secure container facing outwardly from an opposite side of the counter so as not to be accessible to customers at the two dispensing locations.

11. The note presenter apparatus of claim 1, wherein the single exit slot of the secure container opens upwardly and is positioned towards an end of the secure container that is closest to the persons having access to the two dispensing locations.

12. The note presenter apparatus of claim 1, wherein the single exit slot of the secure container opens upwardly and is positioned towards an end of the secure container that is farthest from the persons having access to the two dispensing locations and located inside of a counter.

13. The note presenter apparatus of claim 1, wherein the customer has a timed period to remove the notes by pulling them from the gripper and upon expiration of the time period the notes are moved away from one of the two dispensing locations.

14. The note presenter apparatus of claim 1, wherein the note presenter apparatus is detachable as a unit from the secure container.

15. A method of converting a single exit slot secure container to a cash dispenser with a plurality of dispensing openings, the method comprising:

gripping a plurality of stacked notes presented at the single exit slot of the secure container, retracting the stacked notes using a sliding mechanism in a linear direction; and pivoting the sliding mechanism to a plurality of positions around a 360° circle of rotation from a starting position at the single exit slot; and extending the sliding mechanism in a linear direction to present the notes through one of a plurality of dispensing openings to a customer and gripping the plurality of stacked notes until removed by a customer.

16. The method of claim 15, further comprising enclosing the sliding mechanism in a presenter enclosure to secure the notes from customers except for the dispensing openings.

17. The method of claim 15, further comprising rotation of the plurality of stacked notes so that the stacked notes are laying on one side before gripping the notes for transfer.

18. The method of claim 17, further comprising rotating the plurality of stacked notes to an upright position before presenting the notes to a customer in one of the dispensing openings.

19. The method of claim 15, further comprising after a timed interval, removing the notes from the one of the dispensing openings and returning the notes returned to an interior portion of the cash dispenser.

20. A cash dispenser for dispensing cash at a plurality of dispensing locations that are spaced apart such that two or more persons can be positioned at the respective dispensing locations at one time, the cash dispenser comprising:

a secure container for containing cash and for dispensing notes through only one exit slot; and a note presenter apparatus disposed on the secure container for receiving the notes at the only one exit slot and for repositioning the notes in alignment with either one of two of the plurality of dispensing locations, the note presenter apparatus comprising a linearly moveable part to retract the notes from the single exit slot, a rotatable part for moving the notes in a circular motion to a vicinity of either one of the two dispensing locations, and a gripper for gripping a plurality of stacked notes presented at the single exit slot of the secure container and for transporting the plurality of stacked notes to either one of the two dispensing locations, where the notes are presented for release of the notes from the gripper by a customer.

* * * * *